US007918027B2

(12) United States Patent
Colthurst

(10) Patent No.: US 7,918,027 B2
(45) Date of Patent: Apr. 5, 2011

(54) RAZOR HEAD

(75) Inventor: James Richard Colthurst, Hungerford (GB)

(73) Assignees: James Richard Colthurst, Hungerford (GB); Princess Anni-Frid Reuss, Zermatt (CH)

( * ) Notice: Subject to any disclaimer, the term of this patent is extended or adjusted under 35 U.S.C. 154(b) by 743 days.

(21) Appl. No.: 11/029,748

(22) Filed: Dec. 29, 2004

(65) Prior Publication Data

US 2005/0166404 A1 Aug. 4, 2005

Related U.S. Application Data

(63) Continuation of application No. PCT/GB03/02649, filed on Jun. 20, 2003.

(30) Foreign Application Priority Data

Jul. 5, 2002 (GB) ..... 0215624.8

(51) Int. Cl.
*B26B 21/00* (2006.01)

(52) U.S. Cl. ..... 30/50; 30/346.5

(58) Field of Classification Search ..... 30/48, 50, 30/346.5, 346.57, 353, 303, 299
See application file for complete search history.

(56) References Cited

U.S. PATENT DOCUMENTS

| | | | | |
|---|---|---|---|---|
| 534,728 | A * | 2/1895 | Streeter | 30/303 |
| 1,581,310 | A * | 4/1926 | Fetschan | 30/303 |
| 4,663,843 | A * | 5/1987 | Savage | 30/48 |
| D358,969 | S * | 6/1995 | Romanoff | D7/672 |
| D441,260 | S * | 5/2001 | Holcomb | D7/673 |
| 6,263,576 | B1 * | 7/2001 | Drapak et al. | 30/48 |
| 6,519,856 | B1 * | 2/2003 | Dischler | 30/48 |
| 6,651,342 | B1 * | 11/2003 | Walker, Jr. | 30/34.2 |
| 2003/0182802 | A1 * | 10/2003 | Vega et al. | 30/50 |

FOREIGN PATENT DOCUMENTS

| | | |
|---|---|---|
| DE | 19621491 | 12/1997 |
| GB | 2357057 | 6/2001 |
| JP | 2000300865 | 10/2000 |

* cited by examiner

*Primary Examiner* — Boyer D. Ashley
*Assistant Examiner* — Phong H Nguyen
(74) *Attorney, Agent, or Firm* — Carolyn S. Elmore; Mahreen Chaudhry Hoda; Elmore Patent Law Group, P.C.

(57) ABSTRACT

The present invention relates to razor heads and further to razors which include razor heads as defined. In one aspect of the invention the razor heads comprise at least one blade defining a plurality of cutting edges. The cutting edges are arranged to intercept at at least one point at which at least one angle of less than ninety degrees (90°) is formed between the cutting edges. This arrangement enables the cutting edges to impart cutting, sliding and rotary action onto hair being shaved.

16 Claims, 5 Drawing Sheets

FIG. 10a
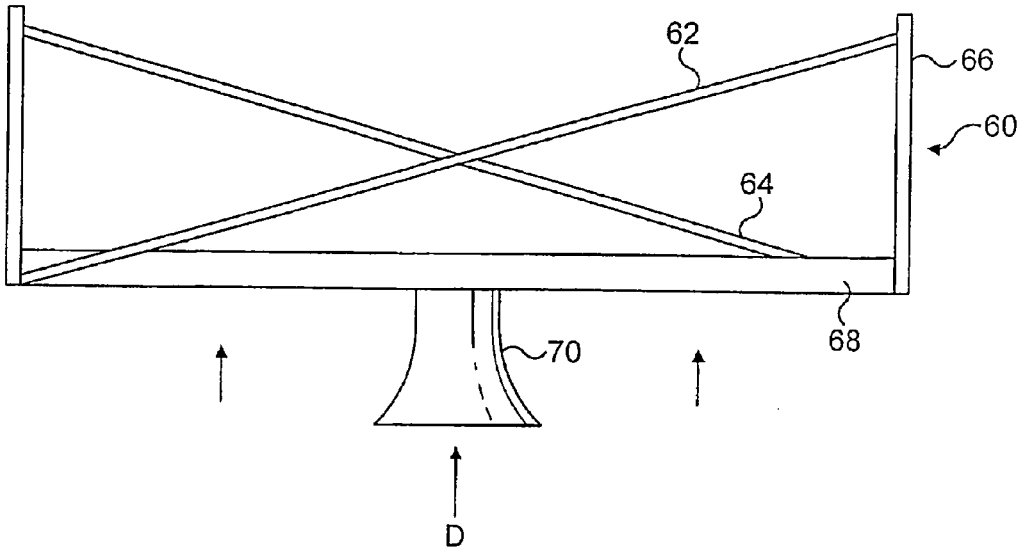
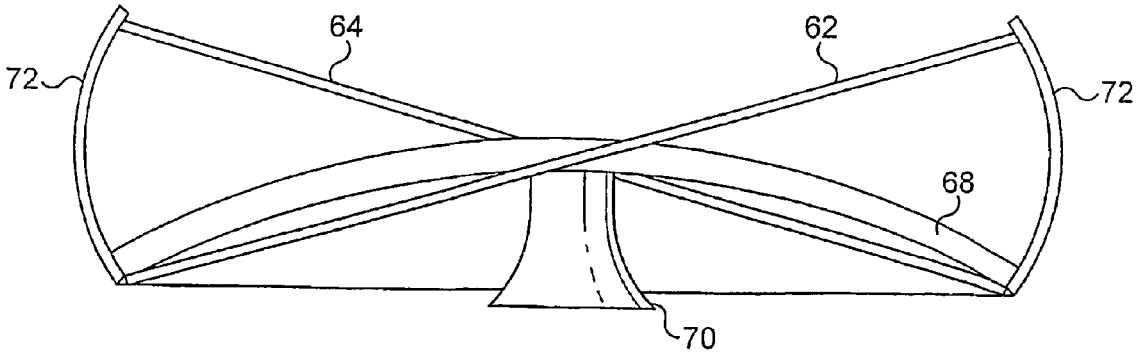
FIG. 10b

RAZOR HEAD

CROSS REFERENCE TO RELATED APPLICATIONS

This application is a continuation of International Application Number PCT/GB2003/002649, which was filed on Jun. 20, 2003 and published as International Publication Number WO 2004/004987 A1 on Jan. 15, 2004, and which, in turn, claims priority benefit from United Kingdom Patent Application Number GB 0215624.8, which was filed on Jul. 5, 2002.

BACKGROUND OF THE INVENTION

Field of the Invention

The present invention relates generally to razor heads and more particularly to razors which include razor heads according to the invention.

Razor heads for use with razors tend to comprise a housing in which one or more blades are provided. The razor head may comprise one or two, or even three such blades. The provision of more than one blade is intended to provide a closer shave during use. In such a case, the blades are set in a parallel alignment to other blades.

However, blades arranged in a parallel alignment only perform a cutting action on the hair/stubble being shaved. This can lead to the user needing to re-use the razor over areas to ensure that a clean shave is attained.

SUMMARY OF THE INVENTION

The present invention seeks to provide a razor head and razor which imparts a cutting and rotary action on to the hair/stubble being shaved.

According to a first aspect of the present invention there is provided a razor head comprising at least one blade defining a plurality of cutting edges, the cutting edges intercepting at at least one point at which at least one angle of less than 90° is formed between the cutting edges.

Preferably, the cutting edges intercept at one point. The cutting edges may intercept at a point substantially midway along their length.

In a preferred embodiment, two cutting edges are provided which may be substantially identical in length and may be defined by a single blade.

Alternatively, the cutting edges may be defined by a separate blade. Preferably the cutting edges define a cross within the razor head.

The razor head may comprise a substantially rectangular housing for the one or more blade(s), the blades preferably being mounted in the housing.

The razor head may be provided with means for releasably connecting the head to a handle. The connection means preferably provides for relative movement between the razor head and the handle in use. The connection means may provide for pivotal connection of the razor head to the handle, such that the razor head pivots relative to the handle.

By providing a razor head that features blades intercepting at least one point thereby forming a cross, the user is able to obtain a closer shave than by using blades arranged parallel to one another. This is because the cutting edges defined by the razor blades in this orientation lead to the provision of a cutting and rotary action onto the hair/stubble.

To enable shaved hairs and residual soap to be readily washed from the razor head, there is preferably provided a cleaning mechanism which may comprise a flexible member mounted in the housing and arranged on application of pressure to a surface thereof to move between the blade(s) defining the cutting edges. Preferably the flexible member is made from flexible plastic material. Preferably a button member is provided on the flexible member, such that upon an application of pressure to the button member, the flexible member is flexed such that it passes between the blades.

According to a second aspect of the present invention there is provided a razor comprising a handle with the razor head of the first aspect of the present invention connected thereto.

Preferably the razor head is releasably connected to the handle. The connection of the razor head to the handle preferably enables relative movement between the razor head and handle in use. Preferably relative pivotal movement is provided such that the razor head pivots relative to the handle.

According to a third aspect of the present invention there is provided a razor head comprising at least one blade mounted in a housing defining at least one cutting edge, wherein at least one angle of less than ninety degrees (90°) is formed between each cutting edge and the housing.

Preferably one blade is provided which may define one cutting edge.

The housing is preferably substantially rectangular. The razor head may be provided with means for releasably connecting the head to a handle. The connection means preferably provides for relative movement between the razor head and the handle in use. The connection means may provide for pivotal connection of the razor head to the handle, such that the razor head pivots relative to the handle.

According to a fourth aspect of the present invention there is provided a razor comprising a handle and the razor head of the third aspect connected thereto.

Preferred aspects of the first to third aspects apply equally to the fourth aspect.

Preferred features of each aspect of the invention are as for each of the other aspects mutatis mutandis.

DESCRIPTION OF THE DRAWINGS

The present invention will now be described by way of example only and with reference to the accompanying drawings, in which:

FIGS. 10*a* and 10*b* are front views of a further razor head of the present invention.

DETAILED DESCRIPTION OF THE PREFERRED EMBODIMENT

Figure 1:
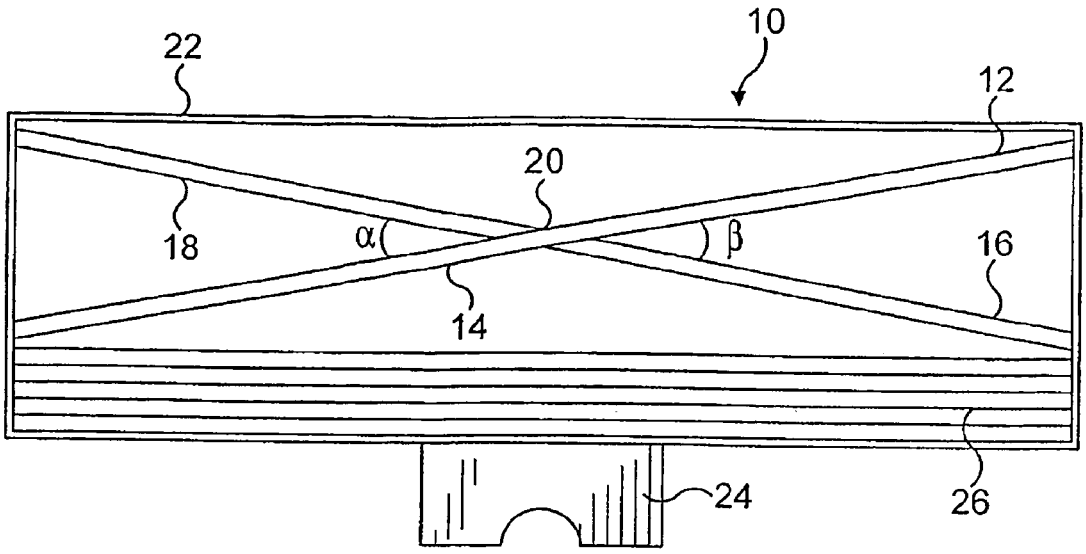
FIG. 1 is a front view of a razor head according to a first aspect of the invention.

FIG. 1 of the accompanying drawings illustrates an embodiment of a razor head according to the present invention. The razor head 10 includes a housing 22 in which razor blades 12, 16 are mounted. Each blade 12, 16 defines a respective cutting edge 14, 18. The cutting edges 14, 18 intercept at a point 20 in the housing 22. At this point 20, angles α, β are defined between the cutting edges. These angles are less than ninety degrees (90°) and in the example shown are substantially identical. Therefore, the blades, 12, 16 and cutting edges 14, 18 define a cross within the housing. The angles may of course be less or greater than those illustrated, though still being less than ninety degrees (90°). Indeed the greater the angle the more pronounced the rotary and cutting action.

Also provided as part of the razor head is a region denoted by reference numeral 26 on which a number of flexible strips are provided. These strips function to pull the hair or stubble upwards before passing the blades there across and would thereby provide for a closer shave. Such strips are well known in the art.

Reference numeral 24 denotes a connecting arrangement for connecting the razor blade 10 to a handle 28 (shown in FIG. 3) such that the razor head 10 can be used during shaving. The connection 24 should enable the razor head 10 to move relative to the handle 28 during use such that the blades 12, 16 and cutting edges 14, 18 can move across the contours of the surface being shaved, for example a person's face. The connection 24, for example, provides for pivotal movement of the razor head 10 relative to the handle 28.

Figure 2:
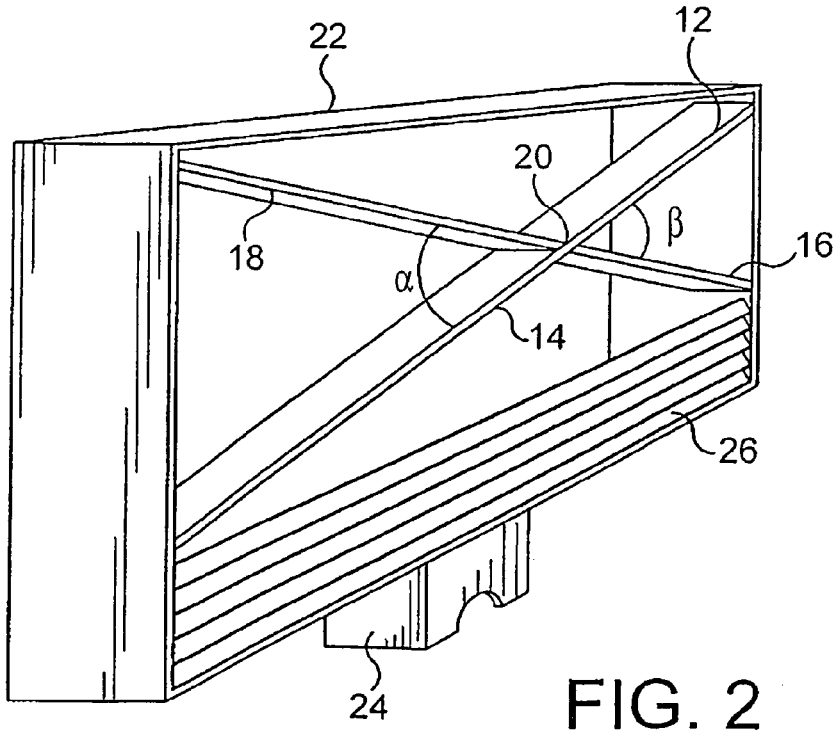
FIG. 2 is a perspective view of the razor head of FIG. 1.

FIG. 2 illustrates a perspective view of the razor head 10. This perspective view illustrates an example of the shape of the razor blades 12, 16 which define the cutting edges 14, 18.

Figure 4:
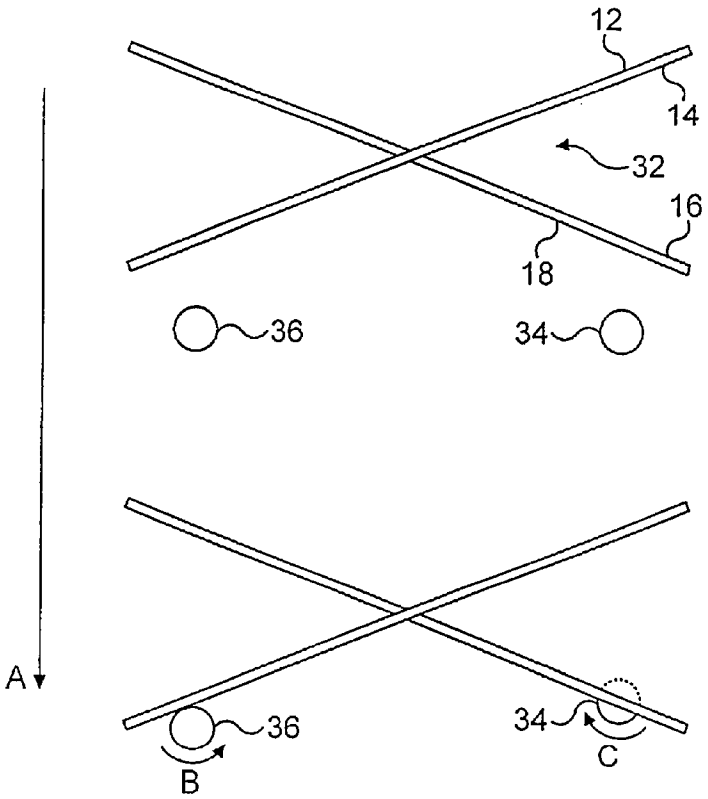
FIG. 4 is a schematic illustration of the action of the razor head of the first aspect of the present invention.
Figure 3:
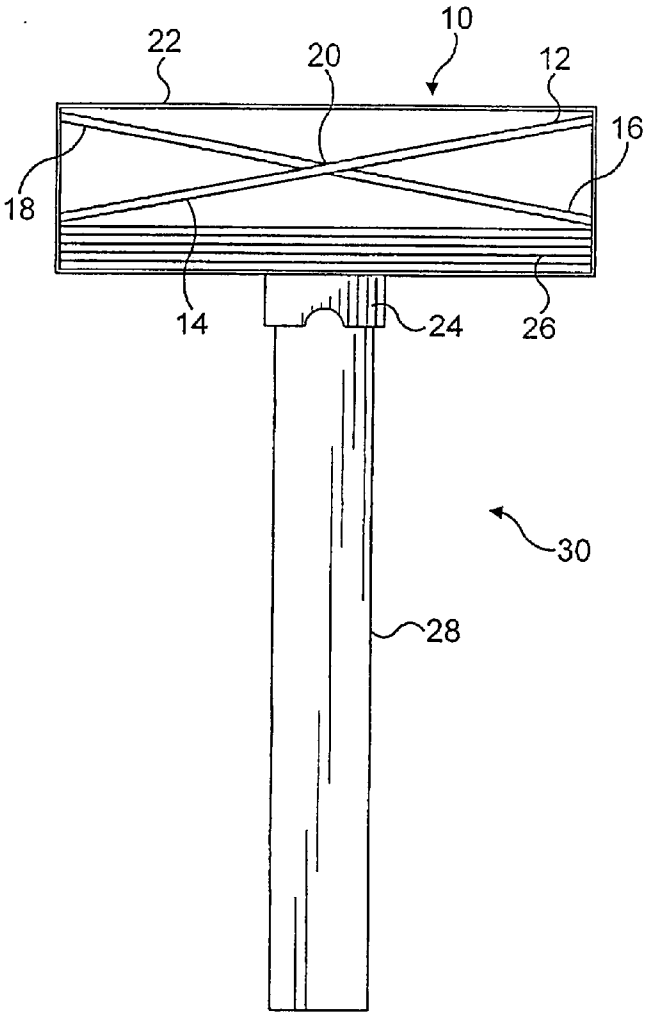
FIG. 3 is a front view of a razor according to a second aspect of the present invention.

FIG. 3 is an illustration of a razor referred to according to the invention which comprises a handle 28 and a razor head 10, as described above. As can be seen, the handle 28 is connected to the razor head 10 through the connecting arrangement 24. This arrangement provides for pivotal movement of the razor head 10 relative to the handle 28. The razor 30 illustrated in FIG. 3 is ready for use by a user when shaving. During shaving, the user would grip the handle 28 of the razor 30 and draw the razor head 10 across the hairs to be shaved. This direction of travel of the razor head 10 relative to the hairs to be shaved, brings the cutting edges 14, 18 of the blades 12, 16 into contact with the hairs to enable the hairs to be cut. As illustrated in FIG. 4, the arrangement of the blades 12, 16 and cutting edges 14, 18 on the razor head 10 causes a cutting, sliding and rotary action to be imparted upon the hairs 34, 36 on movement of the razor head 10 relative thereto in the direction shown by arrow A. The rotary, sliding and cutting movements (denoted by arrows B and C) enables the hair to be cut more cleanly than by a prior art razor.

Figure 5:
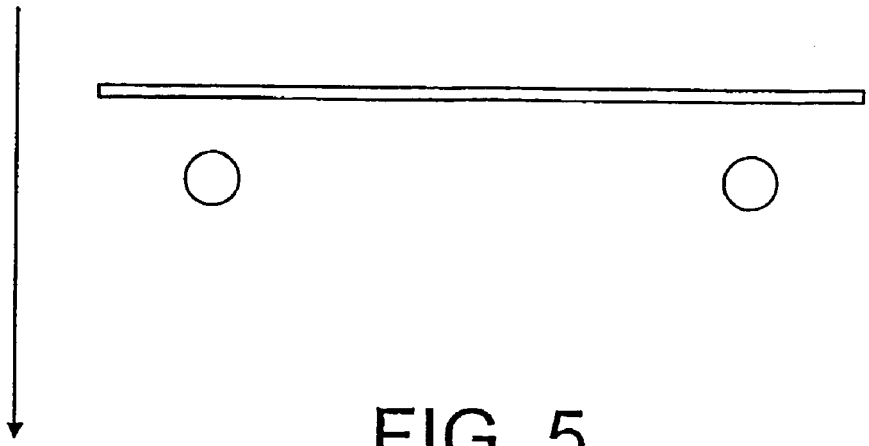
FIG. 5 Prior Art
FIG. 5 is a schematic illustration of the action of a prior art razor head.

In this regard, a prior art standard razor would move relative to the hairs in a manner similar to that illustrated in FIG. 5. In this case, only a cutting action is provided by the razor blades and not a rotary action as with a razor head of the present invention.

Figure 6:
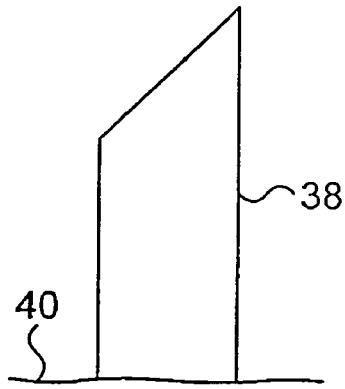
FIG. 6 Prior Art
FIG. 6 is a schematic view of a hair after being cut using a prior art razor head.
Figure 7:
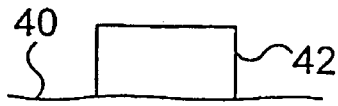
FIG. 7 is a schematic view of a hair after being cut by a razor head of the present invention.

To illustrate this further, FIG. 6 provides a schematic illustration of a hair 38 after being cut by a prior art razor, which comprises one or more blades arranged in a parallel relationship. In contrast, FIG. 7 provides a schematic illustration of a hair 42 which had been cut using a razor head according to the invention. Clearly, a razor head of the present invention would provide a cleaner cut than prior art arrangements.

Figure 8:
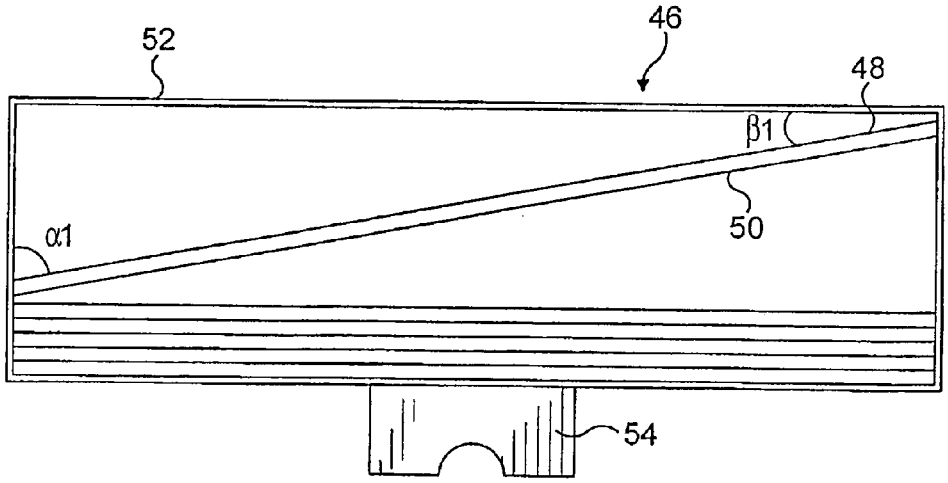
FIG. 8 is a front view of a razor head according to the third aspect of the present invention.
Figure 9:
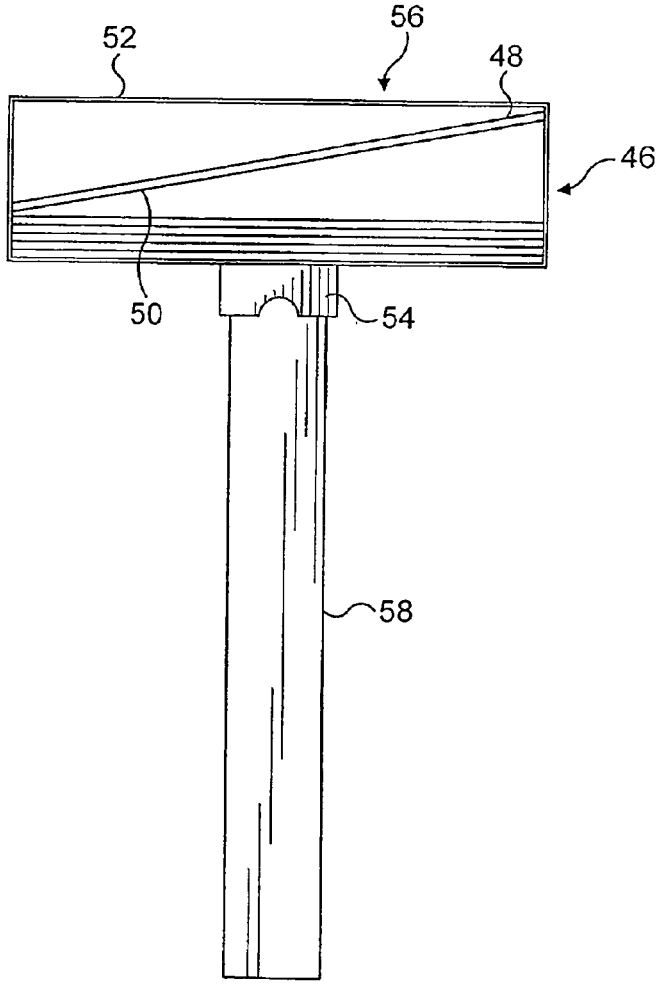
FIG. 9 is a front view of a razor according to the fourth aspect of the present invention.

FIGS. 8 and 9 illustrate further embodiments of the present invention. In FIG. 8 there is shown a razor head 46 which includes a blade 48 defining a cutting edge 50. The blade and cutting edge are mounted in a housing 52 such that the angles α1, β1 between the cutting edge 46 and the housing 52 are less than 90°. The angles may of course be less or greater than those illustrated, though still being less than 90°. Indeed the greater the angle the more pronounced the rotary and cutting action.

FIG. 9 illustrates a razor 56 that includes the razor head 46 and a handle 58. The razor and razor head will also provide a similar rotary, sliding and cutting action onto hair during shaving due to the angle of the cutting edge and as such provide a cleaner shave than prior art arrangements.

Various modifications may be made to the razor head and razor of the present invention without departing from the scope thereof. For example, the cutting edges may be defined by a single blade that is shaped accordingly. In addition, more than two cutting edges may be provided and/or more than two blades may be provided. Also, the housing of the razor head may be of any suitable shape which enables the blades to be securely mounted therein.

As noted above with reference to FIG. 1 and FIG. 8, the angles between the blades may be different to those illustrated. By increasing the angles α, β, α1 and β1, the rotary and cutting action imparted on hairs may be more pronounced.

The razor head may be provided with an arrangement which enables shaved hairs to be readily washed therefrom, during and after shaving. Such an arrangement may comprise a plurality of openings within the housing thereby providing for a flow of water to be achieved therethrough.

In addition, or alternatively, there may be provided an arrangement 68, 70 for cleaning between the blades 62, 64 of the razor head 60. This arrangement is illustrated in FIGS. 10*a* and 10*b*. The arrangement 68, 70 can be in the form of a flexible member 68 having a button member 70. Application of pressure to the button member 70 in the direction of arrow D causes the flexible member 68 to be flexed and moved towards and between the blades 62, 64 thereby cleaning away any shaved hair, excess soap etc. as illustrated in FIG. 10*b*. The housing 66 and the flexible member 68 are made from flexible plastic material such that on application of pressure to the button member 70 flexing occurs thereby enabling the position illustrated in FIG. 10*b* to be attained. On release of pressure on the button member 70 the flexible member 68 and housing 66 can return to the original positions such that the razor head 60 returns to the orientation illustrated in FIG. 10*a*.

The razor of the present invention may be of a disposable type, which is intended to only be used once or twice by a user. Alternatively the razor head and handle of a razor may be adapted to enable replacement of used razor heads with new razor heads as desired.

The razor head may further comprise soothing lotion on the region with one or more of the flexible strips, or on another area provided on the razor head which contacts the user's skin. Such soothing lotion provides a soothing effect on the skin which has been shaved.

Although the foregoing description of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A razor head for shaving, said razor head comprising: a housing having a lateral axis extending between opposite sides thereof; and at least two hair cutting blades mounted in said housing between said opposite sides of said housing, said hair cutting blades each have cutting edges for contacting hairs to cut them, the cutting edges which intersecting at least one point; wherein said cutting edges of said hair cutting blades define an angle therebetween which faces said opposite sides of said housing and is less than ninety degrees, wherein the cutting edges of said hair cutting blade define a shaving surface having a cross therebetween.

2. A razor head as defined in claim 1, wherein said cutting edges of said two hair cutting blades are arranged and configured at an angle that causes a cutting, sliding and rotary action to be imparted upon hairs as said housing is drawn across hairs to be shaved.

3. A razor head for shaving, said razor head comprising:

a housing having a lateral axis extending between opposite sides of said housing, said housing also having top and bottom sides extending between said opposite sides of said housing, wherein the housing is provided with means for connecting it to a handle which may be gripped to draw the razor head across hairs to be shaved;

a first hair cutting blade mounted in said housing between said opposite sides of said housing, said first hair cutting blade being mounted at a first angle with respect to said lateral axis of said housing; and a second hair cutting blade mounted in said housing between said opposite sides of said housing, said second hair cutting blade being mounted at a second angle with respect to said lateral axis of said housing, said second angle being in a direction opposite said first angle;

wherein said first and second hair cutting blades each have cutting edges for contacting hairs to cut them, the cutting edges intersecting at least one point, and wherein the angle between said cutting edges which faces said opposite sides of said housing is less than ninety degrees, and wherein the cutting edges define a shaving surface having a cross therebetween.

4. A razor head as defined in claim 3, wherein said cutting edges intersect at a point substantially midway along their lengths.

5. A razor head as defined in claim 3, wherein said cutting edges are substantially equal in length.

6. A razor head as defined in claim 3, additionally comprising: a mechanism for removably connecting said razor head to a handle.

7. A razor head as defined in claim 3, wherein said cutting edges of said first and second hair cutting blades are arranged and configured at an angle that causes a cutting, sliding and rotary action to be imparted upon hairs as said housing is drawn across hairs to be shaved.

8. A razor head for shaving, said razor head comprising:

a housing having a lateral axis extending between opposite sides of said housing, said housing also having top and bottom sides extending between said opposite sides of said housing, wherein the housing is provided with means for connecting it to a handle which may be gripped to draw the razor head across hairs to be shaved;

a first blade mounted in said housing between said opposite sides of said housing, said first blade being mounted at a first angle with respect to said lateral axis of said housing; and a second blade mounted in said housing between said opposite sides of said housing, said second blade being mounted at a second angle with respect to said lateral axis of said housing, said second angle being in a direction opposite said first angle; and a plurality of flexible strips mounted in said housing near said bottom side thereof, said flexible strips operating to pull hair or stubble upwards before passing the blades there across, thereby providing for a closer shave;

wherein said first and second blades each has a cutting edge which cutting edges intersect at least one point, said angle between said cutting edges which faces opposite sides of said housing is less than ninety degrees, and wherein the cutting edges define a cross therebetween.

9. A razor head as defined in claim 8, wherein the cutting edges intercept at one point.

10. A razor head as defined in claim 8, wherein the cutting edges intercept at a point substantially midway along their lengths.

11. A razor head as defined in claim 8, wherein two cutting edges are provided.

12. A razor head as defined in claim 11, wherein each cutting edge is defined by a separate blade.

13. A razor head as defined in claim 8, wherein the cutting edges are substantially equal in length.

14. A razor head as defined in claim 8, wherein the head is provided with means for removably connecting the housing to a handle.

15. A razor head as defined in claim 14, wherein said connecting means provides for relative movement between the razor head and the handle in use.

16. A razor comprising a handle and a razor head connected thereto, the razor head being as defined in claim 8.

* * * * *